US009689550B2

(12) United States Patent
Tai

(10) Patent No.: US 9,689,550 B2
(45) Date of Patent: Jun. 27, 2017

(54) VEHICULAR LAMP DEVICE

(71) Applicant: MIN HSIANG CORPORATION, Tainan (TW)

(72) Inventor: Shang-kuei Tai, Taipei (TW)

(73) Assignee: MIN HSIANG CORPORATION, Tainan (TW)

( * ) Notice: Subject to any disclaimer, the term of this patent is extended or adjusted under 35 U.S.C. 154(b) by 240 days.

(21) Appl. No.: 14/796,629

(22) Filed: Jul. 10, 2015

(65) Prior Publication Data

US 2017/0009952 A1 Jan. 12, 2017

(51) Int. Cl.

| | |
|---|---|
| ***F21S 8/10*** | (2006.01) |
| *F21Y 115/10* | (2016.01) |
| *F21Y 105/18* | (2016.01) |

(52) U.S. Cl.

CPC ..... *F21S 48/24* (2013.01); *F21S 48/1241* (2013.01); *F21S 48/1329* (2013.01); *F21S 48/236* (2013.01); *F21S 48/1154* (2013.01); *F21S 48/1225* (2013.01); *F21S 48/215* (2013.01); *F21Y 2105/18* (2016.08); *F21Y 2115/10* (2016.08)

(58) Field of Classification Search

CPC ..... F21S 48/1225; F21S 48/1317

See application file for complete search history.

(56) References Cited

U.S. PATENT DOCUMENTS

| | | | | |
|---|---|---|---|---|
| 7,914,162 | B1 * | 3/2011 | Huang | B60L 1/14 219/220 |
| 8,461,603 | B2 * | 6/2013 | Wu | F21V 19/003 174/520 |
| 2004/0114392 | A1 * | 6/2004 | Hou | B60Q 1/2696 362/545 |
| 2014/0146556 | A1 * | 5/2014 | Kao | F21S 48/215 362/518 |
| 2016/0238211 | A1 * | 8/2016 | Herbin | F21S 48/211 |

* cited by examiner

*Primary Examiner* — Elmito Breval

(57) ABSTRACT

A vehicular lamp device includes a lighting device mounted in the compartment of a lamp seat and includes a circuit board on which lighting elements are mounted. A reflective seat is mounted in the compartment and includes a reflective board having a reflective face. A lens seat is mounted in the compartment, includes lens portions located in front of the lighting elements, and includes a hollow portion aligned with the reflective board. Each lens portion includes a light input portion, a light guiding portion, and a first light output face. A refractive portion extends from a front end of each light guiding portion. A front cover includes a light transmitting portion aligned with the first light output portions. The front cover further includes a half reflective portion aligned with the reflective face. The half reflective portion includes a partially transparent front surface and a partially reflective rear surface.

10 Claims, 8 Drawing Sheets

A - A

VEHICULAR LAMP DEVICE

BACKGROUND OF THE INVENTION

The present invention relates to a vehicular lamp device and, more particularly, to a vehicular lamp device providing two different lighting patterns for illumination and alarming purposes.

A conventional vehicular lamp includes a lens mounted in front of lighting elements which emit light rays transmitting through the lens to provide illumination in front of a vehicle for illumination and alarming purposes. However, the lighting pattern outputted through the lens of the conventional vehicular lamp is fixed.

U.S. Pat. No. 7,249,874 discloses a fully reflective two-way lens mounted in a rear portion of a housing. A strip is bonded to an interior periphery of the housing and is provided with a plurality of light-emitting didoes (LEDs). A one-way lens is mounted in front of the strip and is parallel to the two-way lens. The one-way mirror has a substantially transparent or translucent front circular surface which can be viewed from the front of the housing, and a rear partially reflective circular surface which faces the reflecting surface of the two-way minor. When the LEDs are illuminated, light reflects back and forth between the two-way minor and the one-way minor to present a series of constantly converging light streams forming an endless tunnel of light.

However, most of the light rays emitted by the LEDs cannot transmit the one-way lens, providing a low brightness and a small alarming effect. Furthermore, the lighting pattern corresponds to the arrangement of the LEDs and is obviously in the form of several layers of points, failing to provide obvious bright points.

BRIEF SUMMARY OF THE INVENTION

An objective of the present invention is to provide a vehicular lamp device providing two different lighting patterns for illumination and alarming purposes.

A vehicular lamp device according to the present invention includes a lamp seat including a back board and a compartment delimited by the back board. A lighting device is mounted in the compartment of the lamp seat and includes a circuit board on which a plurality of lighting elements is mounted. A reflective seat is mounted in the compartment of the lamp seat. The reflective seat includes a reflective board having a reflective face on a front side thereof. The lighting device is located between the back board of the lamp seat and the reflective seat along a longitudinal axis. Each of the plurality of lighting elements is spaced from the longitudinal axis in a radial direction perpendicular to the longitudinal axis. A lens seat is mounted in the compartment of the lamp seat. The lens seat includes a plurality of lens portions located in front of the plurality of lighting elements. The lens seat further includes a hollow portion aligned with the reflective board of the reflective seat. Each of the plurality of lens portions includes a light input portion on a rear side thereof. Each of the plurality of lens portions further includes a light guiding portion in front of the light input portion and a first light output face in front of the light guiding portion and parallel to the light input portion. A refractive portion extends from a front end of each light guiding portion towards the longitudinal axis. A front cover is mounted outside of the lens seat. The front cover includes a light transmitting portion aligned with the first light output portions of the lens seat. The front cover further includes a half reflective portion aligned with the reflective face. The half reflective portion includes a partially transparent front surface and a partially reflective rear surface.

A portion of light rays emitted from each of the plurality of lighting elements entering the light guiding portion of a corresponding one of the plurality of lens portions transmits through the first light output face of the corresponding one of the plurality of lens portions and the light transmitting portion of the front cover and is projected forwards to form a transmitted lighting pattern area.

Another portion of the light rays entering each light guiding portion is projected onto the reflective face of the reflective seat after refraction by the refractive portion, is reflected to the partially reflective rear surface of the half reflective portion of the front cover, and is then reflected back and forth between the reflective face of the reflective seat and the partially reflective rear surface of the half reflective portion of the front cover, forming a layered lighting pattern area towards the longitudinal axis.

The plurality of lighting elements mainly emits the light rays forwards. Each of the plurality of light guiding portions of the lens seat can include a first refractive face distant to the longitudinal axis. The first refractive face is configured to refract the light rays to the refractive portion. The refractive portion can include a second refractive face. The light rays refracted from the first refractive face can be refracted rearwards by the second refractive face. The refractive portion can further include a second light output face on a rear side thereof. The second light output face is configured to project the light rays onto the reflective face.

The plurality of lighting elements can be arranged annularly or arranged rectilinearly on a portion of the lens seat.

Each first light output face of the lens seat can include a plurality of continuous serrations.

Each second light output face of the lens seat can include a plurality of continuous serrations.

The light transmitting portion of the front cover can include a rear face having a plurality of continuous serrations.

In an example, the back board of the lamp seat includes a peripheral edge. A peripheral board extends forwards along the peripheral edge of the back board along the longitudinal axis. The back board and the peripheral board define the compartment having a front opening. The reflective seat is mounted in front of the lighting device. The reflective seat includes a plurality of through-holes surrounding the reflective board and located corresponding to the plurality of lighting elements. The reflective seat further includes a partitioning wall projecting forwards along the longitudinal axis and surrounding the reflective board.

Each of the plurality of lighting elements can be a light-emitting diode. The number of the plurality of lens portions of the lens seat can be identical to the number of the plurality of lighting elements.

The light input portion of each of the plurality of lens portions can include a recessed portion aligned with one of the plurality of lighting elements. The recessed portion is configured for concentrating light rays.

The front cover can be coupled to the lamp seat to enclose the compartment.

The present invention will become clearer in light of the following detailed description of illustrative embodiments of this invention described in connection with the drawings.

DETAILED DESCRIPTION OF THE INVENTION

Figure 1:
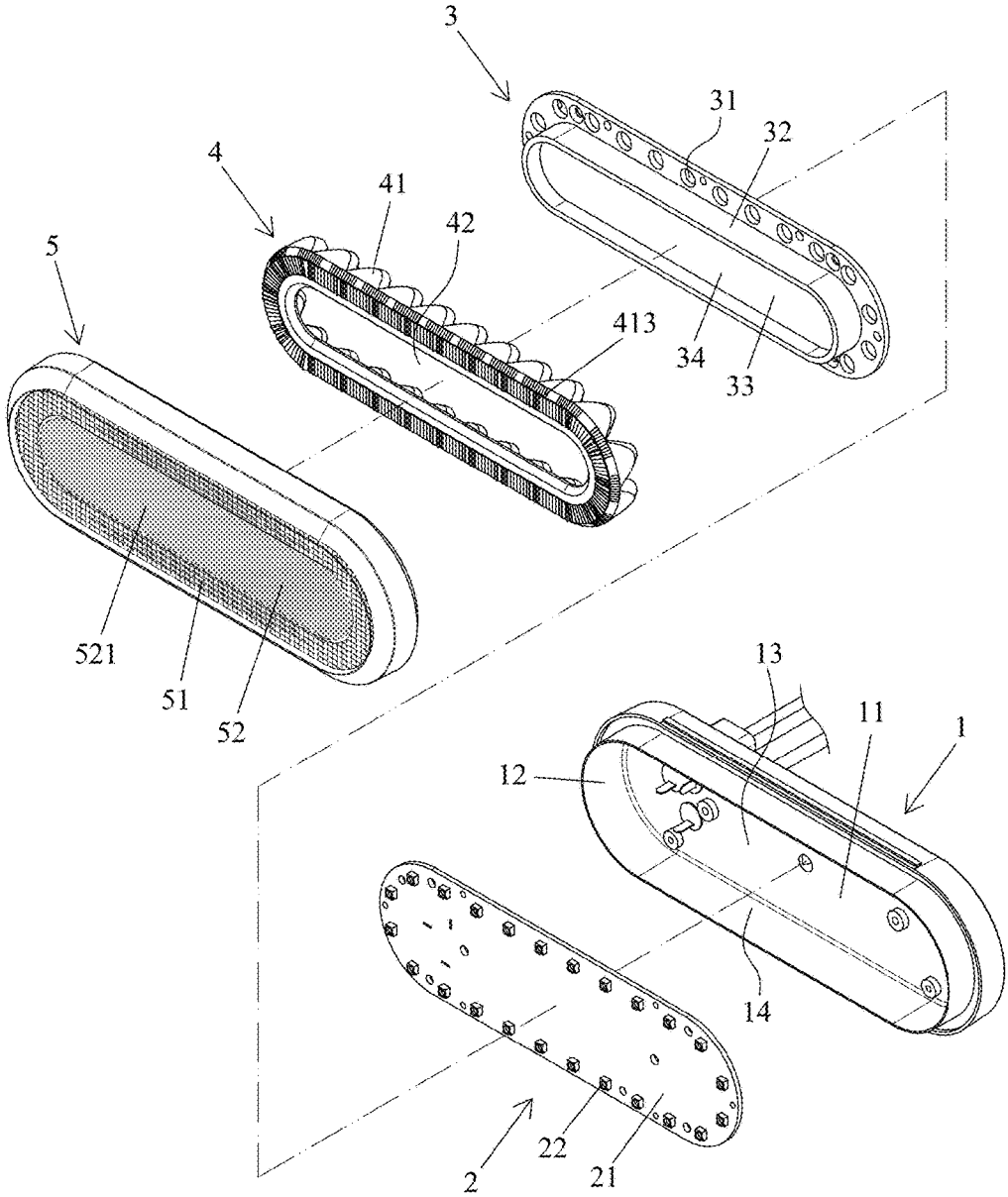
FIG. 1 is an exploded, perspective view of a vehicular lamp device of a first embodiment according to the present invention.
Figure 2:
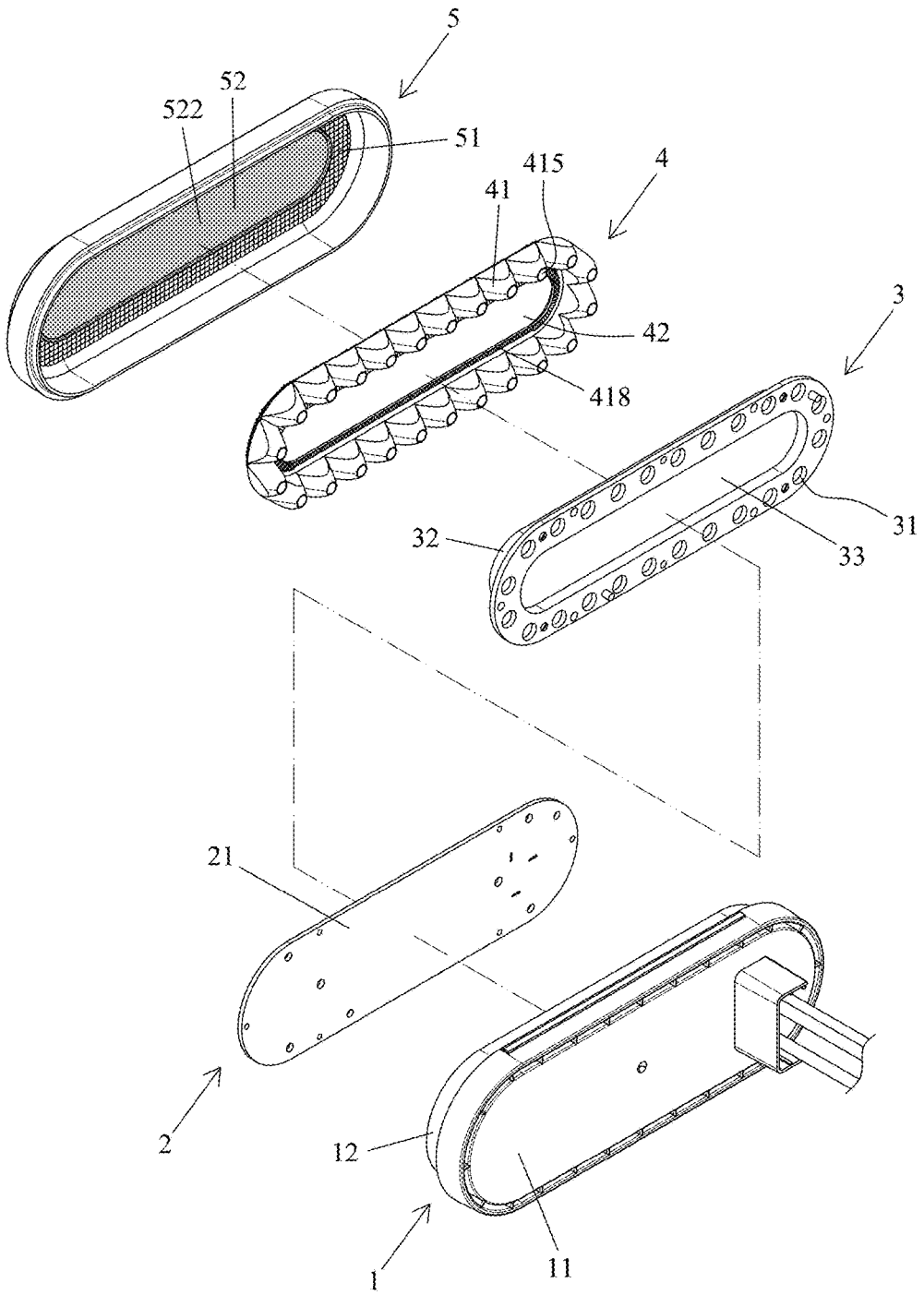
FIG. 2 another exploded, perspective view of the vehicular lamp device of the first embodiment according to the present invention.
Figure 3:
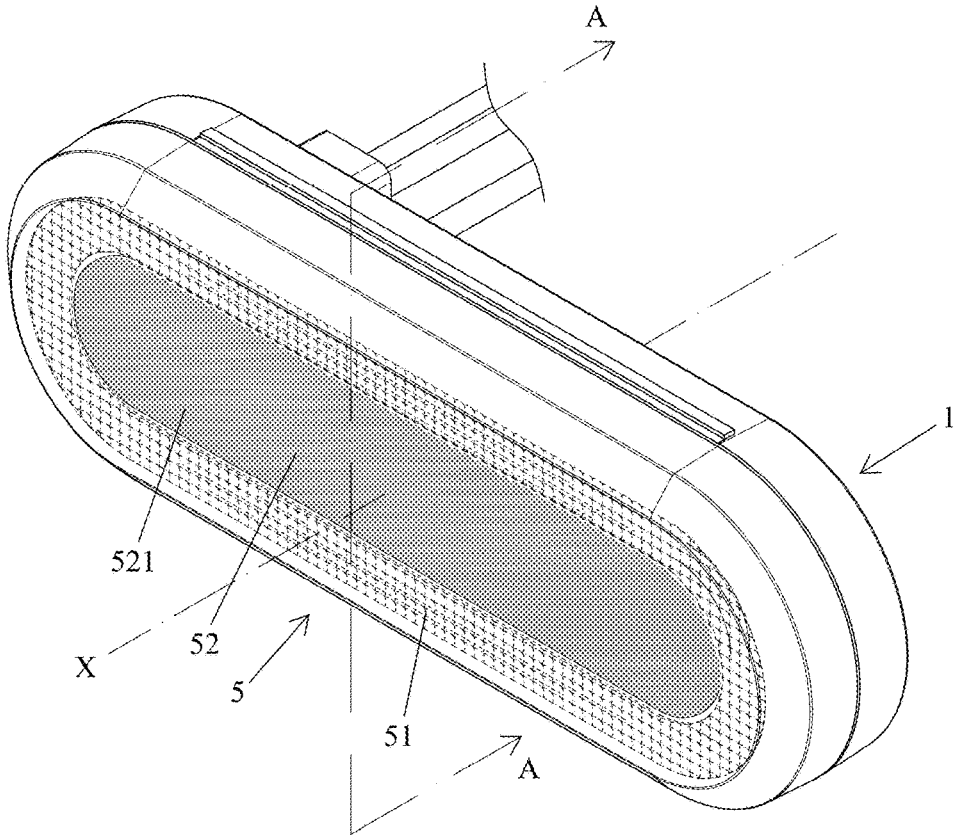
FIG. 3 is a perspective view of the vehicular lamp device of the first embodiment according to the present invention.
Figure 4:
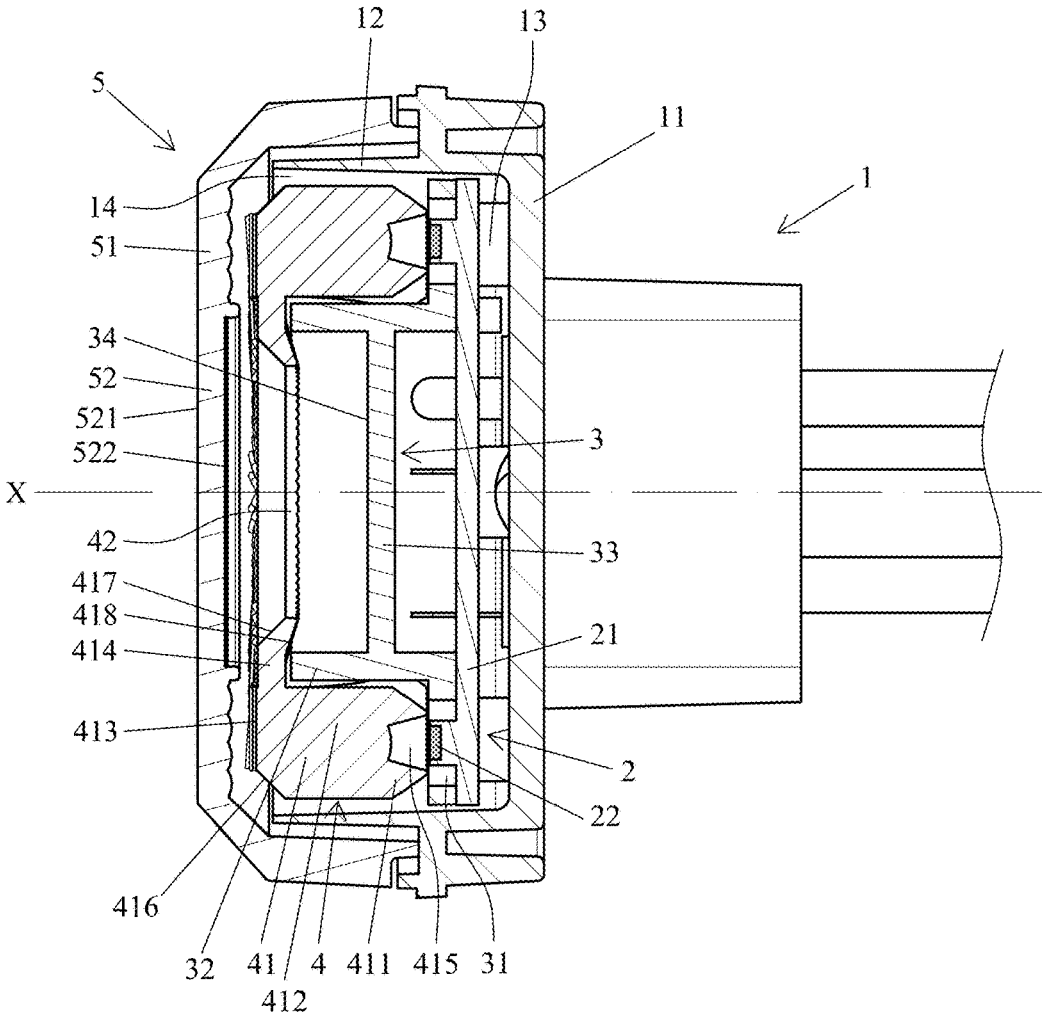
FIG. 4 is a cross sectional view taken along section line A-A of FIG. 3.

With reference to FIGS. 1-4, a vehicular lamp device of a first embodiment according to the present invention includes a lamp seat 1, a lighting device 2, a reflective seat 3, a mirror seat 4, and a front cover 5. The lamp seat 1 includes a back board 11 having a peripheral edge. A peripheral board 12 extends forwards along the peripheral edge of the back board 11 along a longitudinal axis X of the vehicular lamp device. The back board 11 and the peripheral board 12 define a compartment 13 having a front opening 14.

The lighting device 2 is mounted in the compartment 13 of the lamp seat 1. The lighting device 2 includes a circuit board 21. A plurality of lighting elements 22 is mounted on the circuit board 21 and is spaced from the longitudinal axis X in a radial direction perpendicular to the longitudinal axis X. Each lighting member 22 can be a light-emitting diode (LED) and mainly emits light rays forwards. In this embodiment, the lighting elements 22 are arranged annularly.

The reflective seat 3 is mounted in the compartment 13 of the lamp seat 1 and is located in front of the lighting device 2. The reflective seat 3 includes a reflective board 33 having a reflective face 34 on a front side thereof. The longitudinal axis X passes through the reflective board 33. The lighting device 2 is located between the back board 11 of the lamp seat 1 and the reflective seat 3 along the longitudinal axis X. The reflective seat 3 includes a plurality of through-holes 31 surrounding the reflective board 33 and located corresponding to the lighting elements 22. The reflective seat 3 further includes a partitioning wall 32 projecting forwards along the longitudinal axis X and surrounding the reflective board 33.

The lens seat 4 is mounted in the compartment 13 of the lamp seat 1 and is located in front of the reflective seat 3. The lens seat 4 includes a plurality of lens portions 41 located in front of the lighting elements 22. The number of the lens portions 41 of the lens seat 4 can be identical to the number of the lighting elements 22. The lens seat 4 further includes a hollow portion 42 aligned with the reflective board 33 of the reflective seat 3. Each lens portion 41 includes a light input portion 411 on a rear side thereof. Each lens portion 41 further includes a light guiding portion 412 in front of the light input portion 411 and a first light output face 413 in front of the light guiding portion 412 and parallel to the light input portion 411. A refractive portion 414 extends from a front end of each light guiding portion 412 towards the longitudinal axis X. The light input portion 411 of each lens portion 41 includes a recessed portion 415 aligned with one of the lighting elements 22. The recessed portion 415 is configured for concentrating light rays and for guiding the light rays into the light guiding portion 412. A portion of light rays emitted from each lighting element 22 can be refracted by the refractive portion 414 to the reflective face 34 of the reflective seat 3.

Each light guiding portion 41 of the lens seat 4 further includes a first refractive face 416 distant to the longitudinal axis. The first refractive face 416 is configured to refract the light rays to the refractive portion 414. A side of the first refractive face 416 is connected to the first light output face 413, such that a portion of the light rays guided into the light guiding portion 412 can transmit through the first light output face 413, and such that another portion of the light rays can be refracted by the first refractive face 416 to the refractive portion 414. The first light output face 413 includes a plurality of continuous serrations for dispersing the light. The refractive portion 414 further includes a second refractive face 417. The light rays refracted from the first refractive face 416 are refracted rearwards by the second refractive face 417. The refractive portion 414 further includes a second light output face 418 on a rear side thereof. The second light output face 418 is configured to project the light rays onto the reflective face 34.

The front cover 5 is mounted outside of the lens seat 4 and is coupled to the lamp seat 1 to enclose the compartment 13. The front cover 5 includes a light transmitting portion 51 aligned with the first light output portions 413 of the lens seat 4. The light transmitting portion 51 includes a rear face having a plurality of continuous serrations. The front cover 5 further includes a half reflective portion 52 aligned with the reflective face 34. The half reflective portion 52 includes a partially transparent front surface 521 and a partially reflective rear surface 522.

Figure 5:
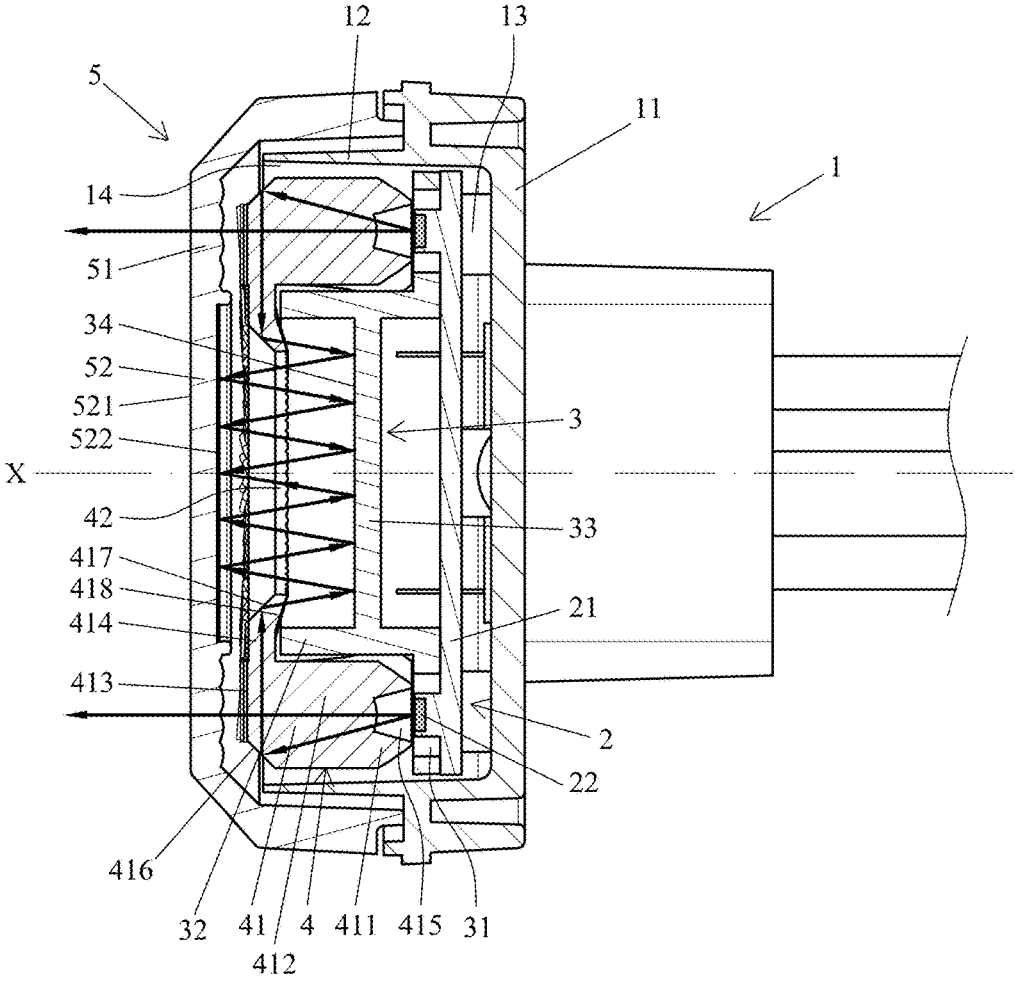
FIG. 5 is a view similar to FIG. 4, illustrating operation of the vehicular lamp device of the first embodiment according to the present invention.
Figure 6:
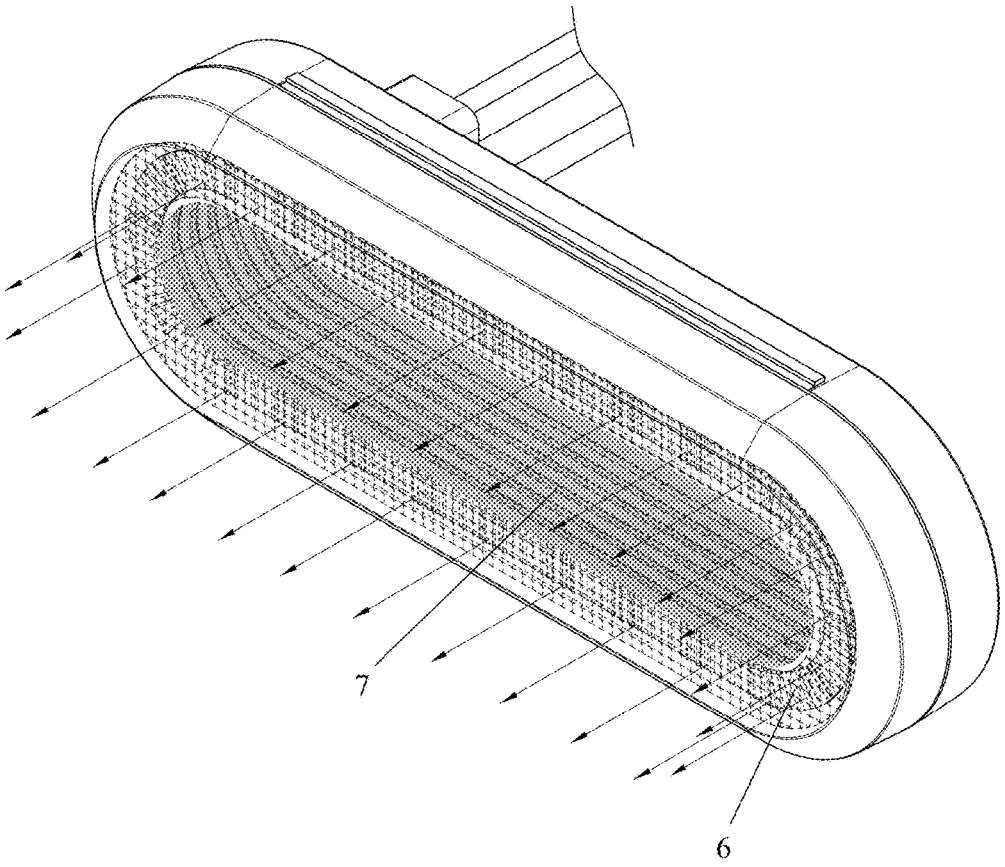
FIG. 6 is a front, perspective view illustrating illuminating patterns of the vehicular lamp device of the first embodiment according to the present invention.

With reference to FIGS. 5 and 6, in operation, the light rays emitted from each lighting element 22 enters the light guiding portion 412 of a corresponding lens portion 41 via the recessed portion 415 of the corresponding lens portion 41. A portion of the light rays transmits through the first light output face 413 of the corresponding lens portion 41 and the light transmitting portion 51 of the front cover 5 and is projected forwards to provide an illumination/alarming effect and to form a transmitted lighting pattern area 6. The serrated faces of the first light input face 413 and the light transmitting portion 51 disperse the light rays to avoid generation of lighting points corresponding to the locations of the lighting elements 22 while outputting a uniform lighting pattern.

Another portion of the light rays entering each light guiding portion 412 is refracted by the first refractive face 416 to the second refractive face 417 of the refractive portion 414, is refracted by the second refractive face 317, and is then projected by the second light output face 418 to the reflective face 34 of the reflective seat 3. Then, this portion of the light rays is reflected by the reflective face 34 to the partially reflective rear surface 522 of the half reflective portion 52 of the front cover 5, and this portion of the light rays is reflected back and forth between the reflective face 34 of the reflective seat 3 and the partially reflective rear surface 522 of the half reflective portion 52 of the front cover 5, forming a plurality of layers of annular lighting patterns. The serrated second light output face 418 disperses the light rays to avoid generation of lighting points corresponding to the locations of the lighting elements 22 to present a uniform strip with better luminance while forming a layered lighting pattern area 7.

Since the transmitted lighting pattern area 6 provides sufficient luminance, the vehicular lamp device according to the present invention can be used as a tail light, a brake light, a work light, a head light, or a daytime running light of a vehicle. Furthermore, the layered lighting pattern area 7 having a lighting pattern different from the lighting pattern of the transmitted lighting pattern area 6 provides a better alarming effect. Thus, the present invention provides two different lighting patterns by using the same lighting elements 22, reducing the energy loss and saving the costs.

Figure 7:
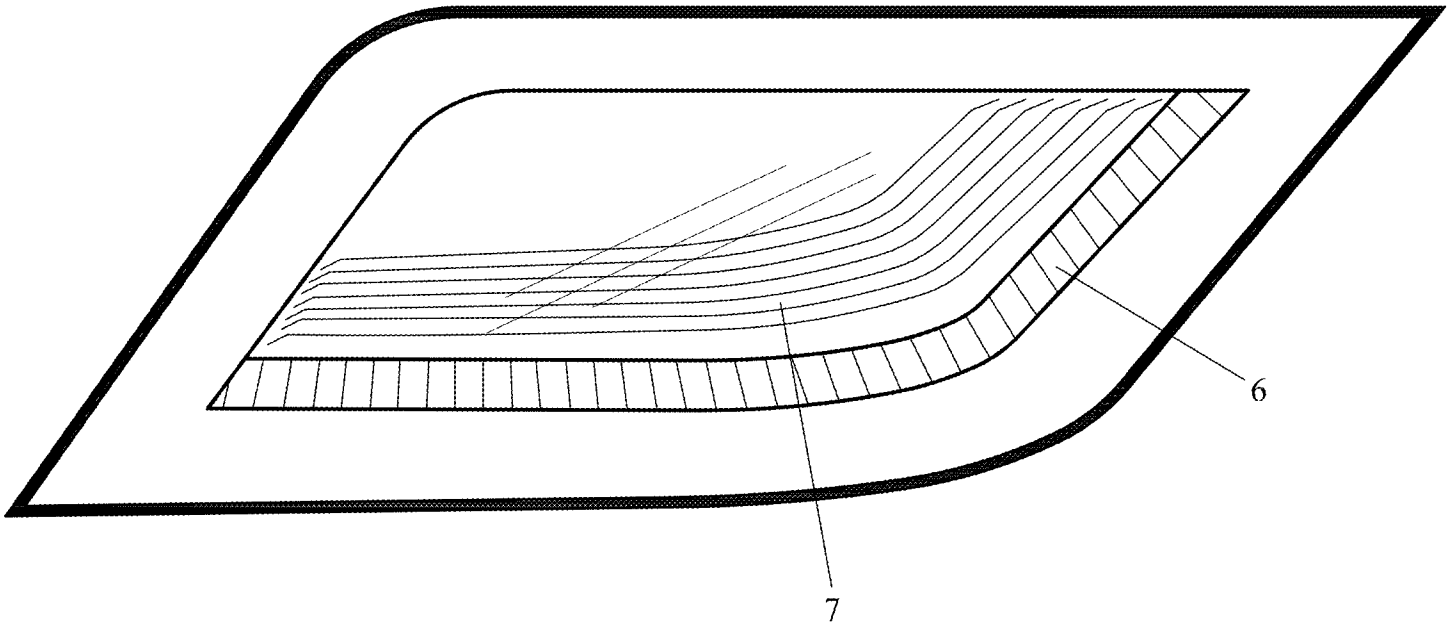
FIG. 7 is a diagrammatic view illustrating illuminating patterns of a vehicular lamp device of a second embodiment according to the present invention.
Figure 8:
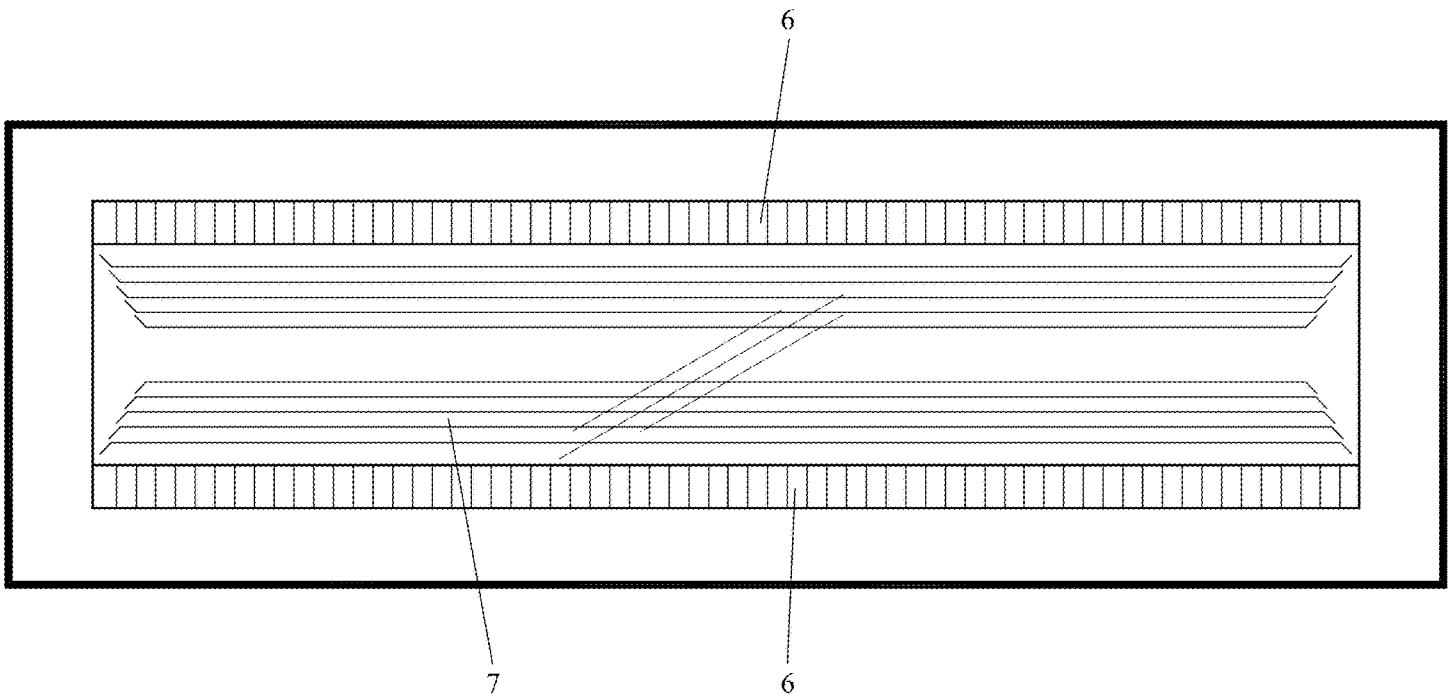
FIG. 8 is a diagrammatic view illustrating illuminating patterns of a vehicular lamp device of a third embodiment according to the present invention.

The lighting elements 22 do not have to be arranged annularly, and the lens portions 41 can be mounted to a local portion to provide different vehicular lighting patterns. Namely, the lighting elements 22 can be arranged rectilinearly on a portion of the lens seat 4. In a vehicular lamp device of a second embodiment shown in FIG. 7, the transmitted lighting pattern area 6 and the layered lighting pattern area 7 are located on a side of the vehicular lamp. In a vehicular lamp device of a third embodiment shown in FIG. 8, the transmitted lighting pattern area 6 and the layered lighting pattern area 7 are located on two sides of the vehicular lamp. Namely, the output locations of the lighting patterns can be disposed according to the shape of the vehicular lamp.

Although specific embodiments have been illustrated and described, numerous modifications and variations are still possible without departing from the scope of the invention. The scope of the invention is limited by the accompanying claims.

The invention claimed is:

1. A vehicular lamp device comprising:

a lamp seat including a back board, with the lamp seat including a compartment delimited by the back board;

a lighting device mounted in the compartment of the lamp seat, with the lighting device including a circuit board, and with a plurality of lighting elements mounted on the circuit board;

a reflective seat mounted in the compartment of the lamp seat, with the reflective seat including a reflective board having a reflective face on a front side thereof, with the lighting device located between the back board of the lamp seat and the reflective seat along a longitudinal axis, and with each of the plurality of lighting elements spaced from the longitudinal axis in a radial direction perpendicular to the longitudinal axis;

a lens seat mounted in the compartment of the lamp seat, with the lens seat including a plurality of lens portions located in front of the plurality of lighting elements, with the lens seat further including a hollow portion aligned with the reflective board of the reflective seat, with each of the plurality of lens portions including a light input portion on a rear side thereof, with each of the plurality of lens portions further including a light guiding portion in front of the light input portion and a first light output face in front of the light guiding portion and parallel to the light input portion, and with a refractive portion extending from a front end of each light guiding portion towards the longitudinal axis; and a front cover mounted outside of the lens seat, with the front cover including a light transmitting portion aligned with the first light output portions of the lens seat, with the front cover further including a half reflective portion aligned with the reflective face, and with the half reflective portion including a partially transparent front surface and a partially reflective rear surface, wherein a portion of light rays emitted from each of the plurality of lighting elements entering the light guiding portion of a corresponding one of the plurality of lens portions transmits through the first light output face of the corresponding one of the plurality of lens portions and the light transmitting portion of the front cover and is projected forwards to form a transmitted lighting pattern area, and wherein another portion of the light rays entering each light guiding portion is projected onto the reflective face of the reflective seat after refraction by the refractive portion, is reflected to the partially reflective rear surface of the half reflective portion of the front cover, and is then reflected back and forth between the reflective face of the reflective seat and the partially reflective rear surface of the half reflective portion of the front cover, forming a layered lighting pattern area towards the longitudinal axis.

2. The vehicular lamp device as claimed in claim 1, with the plurality of lighting elements mainly emitting the light rays forwards, with each of the plurality of light guiding portions of the lens seat including a first refractive face distant to the longitudinal axis, with the first refractive face configured to refract the light rays to the refractive portion, with the refractive portion including a second refractive face, with the light rays refracted from the first refractive face being refracted rearwards by the second refractive face, and with the refractive portion further including a second light output face on a rear side thereof, and with the second light output face configured to project the light rays onto the reflective face.

3. The vehicular lamp device as claimed in claim 2, wherein each first light output face of the lens seat includes a plurality of continuous serrations.

4. The vehicular lamp device as claimed in claim 2, wherein each second light output face of the lens seat includes a plurality of continuous serrations.

5. The vehicular lamp device as claimed in claim 2, wherein the light transmitting portion of the front cover includes a rear face having a plurality of continuous serrations.

6. The vehicular lamp device as claimed in claim 1, wherein the plurality of lighting elements is arranged annularly or arranged rectilinearly on a portion of the lens seat.

7. The vehicular lamp device as claimed in claim 1, with the back board of the lamp seat including a peripheral edge, with a peripheral board extending forwards along the peripheral edge of the back board along the longitudinal axis, with the back board and the peripheral board defining the compartment having a front opening, with the reflective seat mounted in front of the lighting device, with the reflective seat including a plurality of through-holes surrounding the reflective board and located corresponding to the plurality of lighting elements, and with the reflective seat further including a partitioning wall projecting forwards along the longitudinal axis and surrounding the reflective board.

8. The vehicular lamp device as claimed in claim 1, wherein each of the plurality of lighting elements is a light-emitting diode, and wherein a number of the plurality of lens portions of the lens seat is identical to a number of the plurality of lighting elements.

9. The vehicular lamp device as claimed in claim 1, wherein the light input portion of each of the plurality of lens portions includes a recessed portion aligned with one of the plurality of lighting elements, and wherein the recessed portion is configured for concentrating light rays.

10. The vehicular lamp device as claimed in claim 1, wherein the front cover is coupled to the lamp seat to enclose the compartment.

* * * * *